US012376658B2

(12) United States Patent
Zhu

(10) Patent No.: US 12,376,658 B2
(45) Date of Patent: Aug. 5, 2025

(54) COLLAPSIBLE UMBRELLA WITH QUICK CONNECT RIB SECTIONS

(71) Applicant: MAXTON ENGINEERING LTD., Central (HK)

(72) Inventor: Shou Qiang Zhu, Central (HK)

(73) Assignee: MAXTON ENGINEERING LTD., Central (HK)

( * ) Notice: Subject to any disclaimer, the term of this patent is extended or adjusted under 35 U.S.C. 154(b) by 114 days.

(21) Appl. No.: 17/957,857

(22) Filed: Sep. 30, 2022

(65) Prior Publication Data

US 2023/0301406 A1 Sep. 28, 2023

Related U.S. Application Data

(60) Provisional application No. 63/251,418, filed on Oct. 1, 2021.

(51) Int. Cl.
*A45B 25/02* (2006.01)
*A45B 19/10* (2006.01)

(52) U.S. Cl.
CPC ..... *A45B 19/10* (2013.01); *A45B 25/02* (2013.01)

(58) Field of Classification Search
CPC ..... A45B 25/02
See application file for complete search history.

(56) References Cited

U.S. PATENT DOCUMENTS

| | | | | | |
|---|---|---|---|---|---|
| 2,105,225 | A * | 1/1938 | Pollock | A45B 25/06 | 135/30 |
| 2,385,575 | A * | 9/1945 | Isler | A45B 25/02 | 135/29 |
| 5,722,135 | A * | 3/1998 | I-Tsung | A45B 25/02 | 264/150 |
| 5,746,235 | A * | 5/1998 | Lin | A45B 25/02 | 135/32 |
| 7,293,573 | B2 * | 11/2007 | Clarke | A45B 25/14 | 135/98 |
| 7,686,024 | B1 * | 3/2010 | Lai | A45B 25/02 | 135/29 |
| 10,448,715 | B2 * | 10/2019 | Tung | A45B 25/14 | |
| 2010/0139724 | A1 * | 6/2010 | Lai | A45B 25/10 | 135/29 |
| 2010/0139725 | A1 * | 6/2010 | Lai | A45B 25/02 | 135/29 |
| 2012/0180834 | A1 * | 7/2012 | Pineda | A45B 25/10 | 135/25.1 |
| 2022/0312911 | A1 * | 10/2022 | LaPorte | A45B 15/00 | |

* cited by examiner

*Primary Examiner* — Noah Chandler Hawk
(74) *Attorney, Agent, or Firm* — LIU & LIU

(57) ABSTRACT

An umbrella with a frame structure supported by a support structure. The frame structure has a support hub, a plurality of long ribs each comprising a first rib section and a second rib section releasably connected by a pivot rib coupler, wherein each long rib has an end releasably or fixedly coupled to an upper end of the support hub. The frame structure further having a plurality of short rib sections in the form of a plurality of third rib sections, each comprising a first end releasable coupled to the pivot rib coupler and a second end releasably or fixedly coupled to a lower end of the support hub, wherein each pivot rib coupler is configured to pivot the third rib section relative to the first and second rib sections that are releasably coupled to the pivot rib coupler.

18 Claims, 18 Drawing Sheets

COLLAPSIBLE UMBRELLA WITH QUICK CONNECT RIB SECTIONS

FIELD OF THE INVENTION

The present invention is directed to an umbrella with a folding frame, and in particular to an umbrella with a frame having ribs that can be replaced.

BACKGROUND OF THE INVENTION

Large collapsible umbrellas, such as patio umbrellas, may be in the form having a central support post or a side support post.

For a central supported umbrella, it includes a central support post having at its upper end a frame structure that supports a canopy made of a flexible material (e.g. fabric). Heretofore, that frame structure of umbrellas includes a network of ribs configured to allow the canopy material to span or stretch out in an opened state of the umbrella, and to collapse or fold into a closed state for stowing or when the umbrella is not in use. Generally, long ribs are pivotally connected at one end to an upper hub with the free ends of the long ribs extending from the long hub. Short ribs are pivotally connected at one end to a location along respective long ribs and pivotally connected at another end to a lower hub. The upper hub is fixed at the upper end of the post. The lower hub is slidable relative to the upper hub along the central support post, to move towards and away from the upper hub. In the collapsed state of the umbrella, the lower hub is moved away from the upper hub, and the long ribs and the short ribs are pivoted to collapse the long ribs and the short ribs towards the post. When the lower hub is raised towards the upper hub, the short ribs and the long ribs are pivoted to cause the long ribs and short ribs to extend from the respective hub outwards from the post, thereby extending the canopy material to provide under shading the canopy.

For a side supported umbrella (see, e.g., U.S. Pat. No. 10,136,709B2), it includes a side support post having an arm supported by and extending (e.g., cantilevered) from the post, whereby the extended end of the arm supports an upper hub of a frame structure that support a canopy. A lower hub is suspended below the upper hub. Long and short ribs are provided as in the central supported umbrella. The lower hub can be drawn towards and away from the upper hub, to operate the long and short ribs in a similar manner as discussed above in reference to the central supported umbrella.

A collapsible canopy frame structure brings challenges to structural integrity of the frame structure. Heretofore, in order to ensure the structural integrity of the frame structure, the pivot joints between the ribs to the respective upper and lower hubs and between the long and short ribs are implemented using rivets and the like to form the pivot joints. The pivot joints require manufacturing steps that cannot be automated at the point of manufacture. Once assembled, the frame structure is bulky, requiring higher shipping costs from point of manufacturing to users. In recent years, manufacturing and shipping costs have risen significantly. Points of manufacturing are moved to more remote locations, but that would exacerbate shipping costs.

Furthermore, once the overall frame structure including the upper and lower hubs and the long and short ribs are formed into an assembled unit, it cannot be easily disassembled, e.g., to replace a damaged rib. Hence, when a rib is damaged, e.g., bent or broken from use or by strong winds, the damaged rib cannot be replaced by the user. The umbrella would be declared damaged as a whole unit. The damaged umbrella would be tossed, ending in a landfill.

The frame structure may be reinforced with stronger parts and materials, but that would add to manufacturing and material costs, leading to higher shipping costs as well. Hence, a vicious cycle in past attempts to improve the integrity of umbrellas.

U.S. Pat. No. 10,292,466B2 purports to disclose a conceptual idea of removing and placing broken ribs at the hubs. However, the applicant is not aware that the disclosed concept has been proven commercially viable.

There is a need for a simple, reliable and easy to assemble umbrella assembly structure that balances the above noted concerns to optimizes structural integrity along with reduced manufacturing, shipping, and material costs.

SUMMARY OF THE INVENTION

The present invention provides a simple, reliable and easy to assemble collapsible umbrella frame structure that incorporates releasable, removable and/or replaceable quick connect rib sections, which addresses the above noted concerns to optimizes structural integrity along with reduced manufacturing, shipping, and material costs. Hereinafter, "releasable", "removable" and/or "replaceable" connections or couplings are generally referred to as "releasable" couplings or connections, and more specifically connections and couplings of the type user finger operable quick connection without requiring using a tool. The inventive collapsible umbrella assembly can be easily assembled by a user for use and repaired with replacement rib sections after damage to the ribs in the frame structure.

In one aspect of the present invention, the inventive collapsible umbrella comprises a support structure, a frame structure supported by the support structure, comprising: a support hub configured in the form of an assembly (i.e., a support hub assembly); a plurality of long ribs, each comprising a first rib section and a second rib section releasably connected by a pivot rib coupler, wherein each long rib has an end releasably or fixedly coupled to an upper end of the support hub; a plurality of short rib sections in the form of a plurality of third rib sections, each third rib sections comprising a first end releasably coupled to the pivot rib coupler and a second end releasably or fixedly coupled to a lower end of the support hub, wherein each pivot rib coupler is configured to pivot the third rib section relative to the first and second rib sections that are releasably coupled to the pivot rib coupler. Hereinafter, discussions and accompanying drawings of the present invention would be in reference to "support hub" comprising an assembly of components as further described below.

In one embodiment, the pivot rib coupler comprises a straight pivot portion having a first end and a second end, and an angled pivot portion having an end pivotally connected to the straight pivot portion and an extended end, wherein a first end of the first rib section is releasably coupled to the first end of the straight pivot portion of the pivot rib coupler, and a first end of the second rib section is releasably coupled to the second end of the straight pivot portion of the pivot rib coupler, wherein the first end of the third rib section is releasably coupled to the extended end of the angled pivot portion of the pivot rib coupler.

In one embodiment, the support hub comprises an upper hub at the upper end of the support hub, and a plurality of upper pivot hub connectors each having an end pivotally coupled to the upper hub, wherein a second end of each first rib section is releasably or fixedly coupled to an extended end of a corresponding upper pivot hub connector; and a lower hub at the lower end of the support hub, and a plurality of lower pivot hub connector each having an end pivotally coupled to the lower hub, wherein a second end of each third rib section is releasably or fixedly coupled to an extended end of a corresponding lower pivot hub connector.

In one embodiment, the first end and the second end of the straight pivot portion of each pivot rib coupler, the extended end of the angled pivot portion of each pivot rib coupler, the extended end of each upper pivot hub connector, and the extended end of each lower pivot hub connector, are each an opened end configured as a coupling opening to receive an end of a corresponding one of the first, second and third rib sections.

The umbrella support structure may comprise a central support post, wherein the frame structure is supported at an upper end of the central support post, or a side support post and an arm cantilevered from the side support post, wherein the frame structure is supported at an extended end of the arm.

In one embodiment, the first end of each of the first rib sections, the second rib sections and the third rib sections are releasably coupled to the corresponding first, second and extended ends of the pivot rib coupler, the second end of each of the first rib sections is releasably coupled to the corresponding extended end of the upper pivot hub connector, and the second end of each of the third rib sections is releasably coupled to the corresponding extended end of the lower pivot hub connector, via a user finger operated releasable coupling that does not require using an external tool for a user to release the coupling.

In one embodiment, the releasable coupling comprises a push button spring clip at the first and second ends of each of the first and third rib sections, and the first end of each of the second rib section, and a complementary opening at the corresponding first, second and extended ends of the pivot rib coupler, extended end of the upper pivot hub connector and extended end of the lower pivot hub connector. To facilitate ease of use, the releasable coupling may comprise a double push button spring clip.

At least two of the first rib section, the second rib section and the third rib section may be similar in length and are interchangeable, to reduce part variations (e.g., the first and third rib sections may have similar length and interchangeable). In another embodiment, the first rib section, the second rib section and the third rib section are all similar in length and are interchangeable.

At least a portion at the respective ends of the various rib sections may be provided with a cross-sectional shape that is non-symmetrical about at least one axis in the sectional plane, to facilitate matching of the ends of the rib sections to complementary openings at the corresponding first, second and extended ends of the pivot rib coupler, extended end of the upper pivot hub connector and extended end of the lower pivot hub connector. In one embodiment, the cross-sectional shape conforms to a rounded top and generally flat bottom.

In a further embodiment, instead of releasably coupling to the upper end and lower end of the support bub as in the above described embodiments, each long rib has an end fixedly coupled to the upper end of the support hub, and each third rib sections comprises a second end fixedly coupled to a lower end of the support hub. As in the above described embodiments, an upper hub is provided at the upper end of the support hub and a plurality of upper pivot hub connectors each having an end pivotally coupled to the upper hub, wherein a second end of each first rib section is fixedly coupled to an extended end of a corresponding upper pivot hub connector; and a lower hub is provided at the lower end of the support hub and a plurality of lower pivot hub connectors each having an end pivotally coupled to the lower hub, wherein a second end of each third rib section is fixedly coupled to an extended end of a corresponding lower pivot hub connector.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

The present invention provides a simple, reliable and easy to assemble collapsible umbrella assembly structure that incorporates releasable, removable and/or replaceable quick connect rib sections, which addresses the above noted concerns to optimizes structural integrity along with reduced manufacturing, shipping, and material costs. The inventive collapsible umbrella assembly can be easily assembled for use and repaired with replacement rib sections after damage to the ribs in the frame structure. The present invention balances and optimizes structural integrity along with reduced manufacturing, shipping, and material costs.

Figure 1:
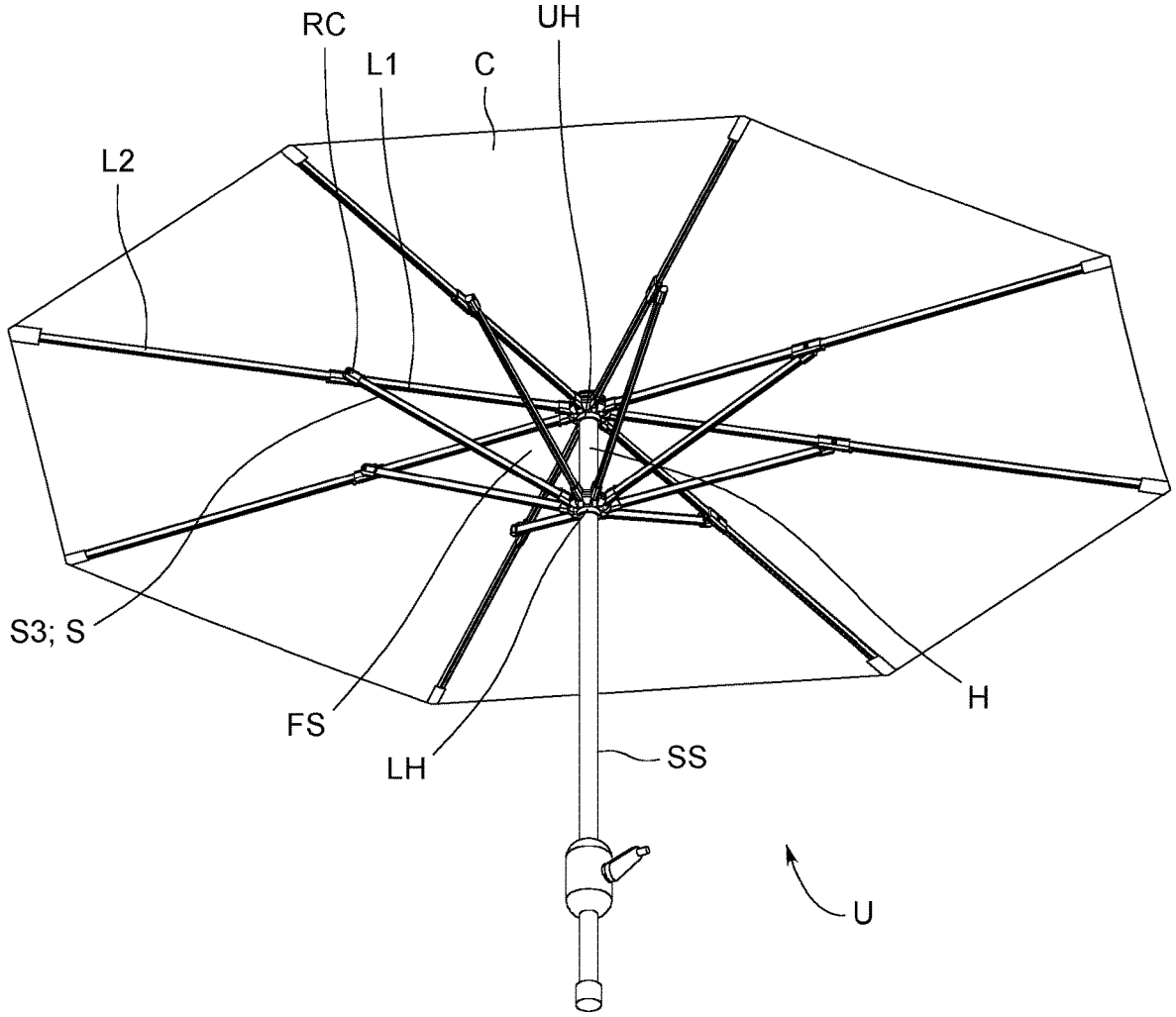
FIGS. 1-3 are various perspective views of a collapsible umbrella, depicted in a fully extended state, comprising a frame structure supported on a central support post, in accordance with one embodiment of the present invention.
Figure 2:
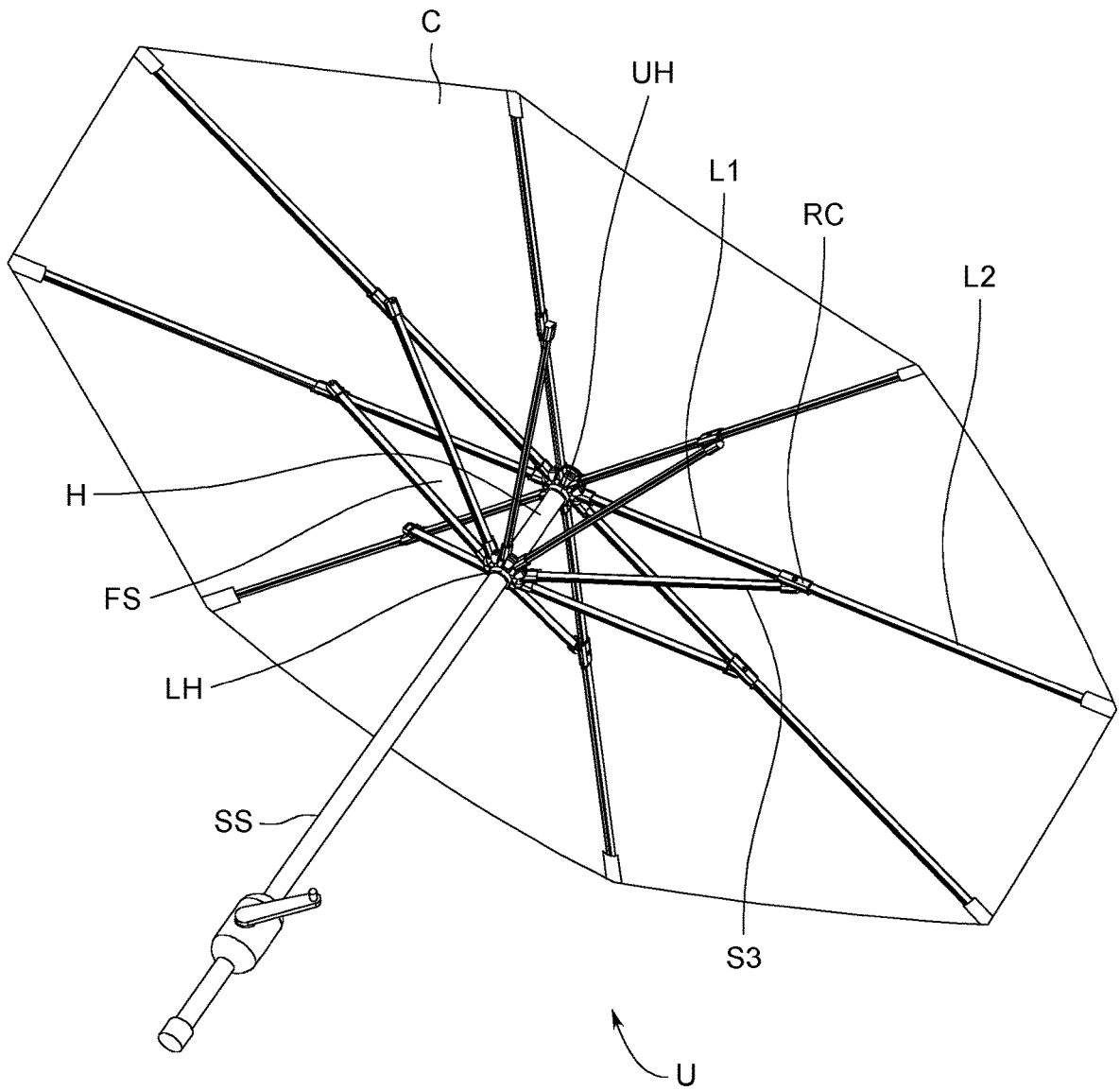
Figure 3:
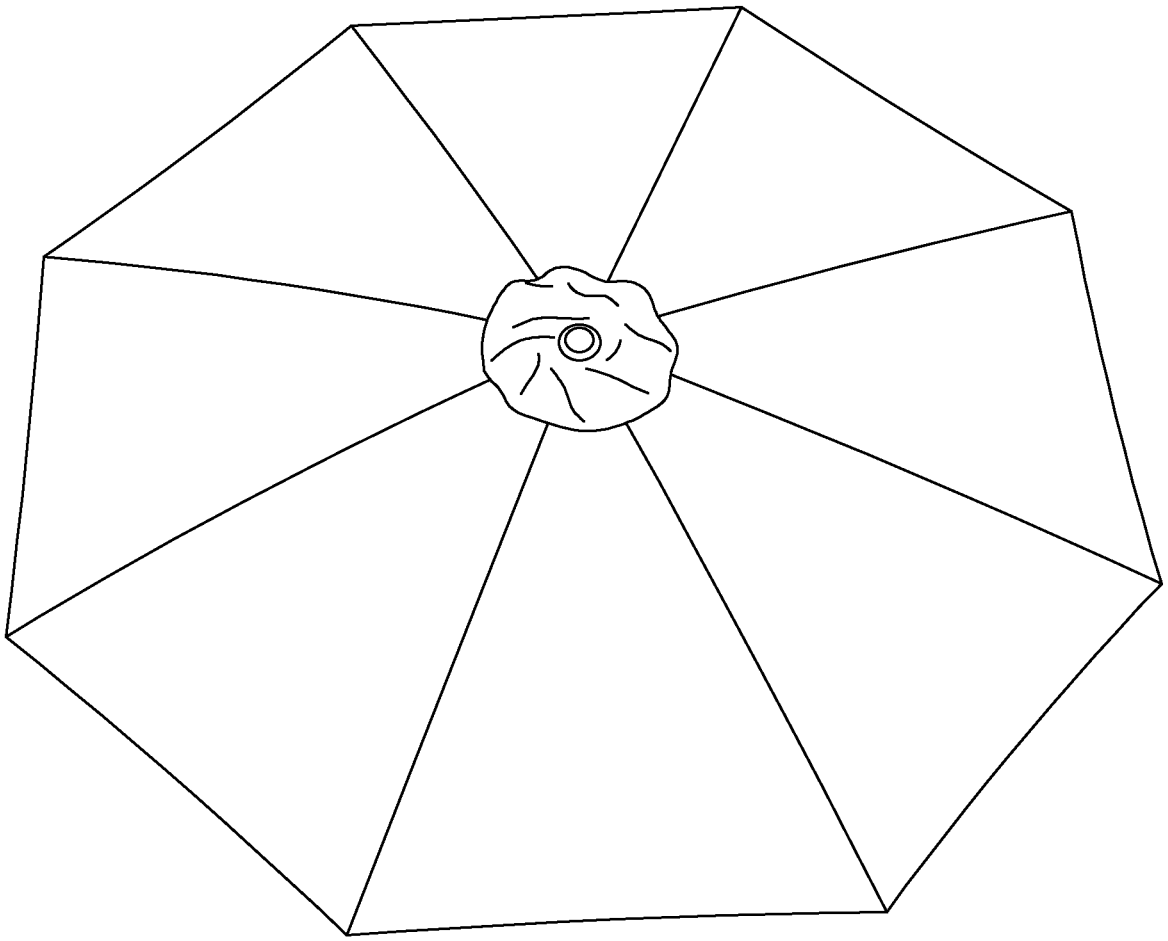
Figure 4:
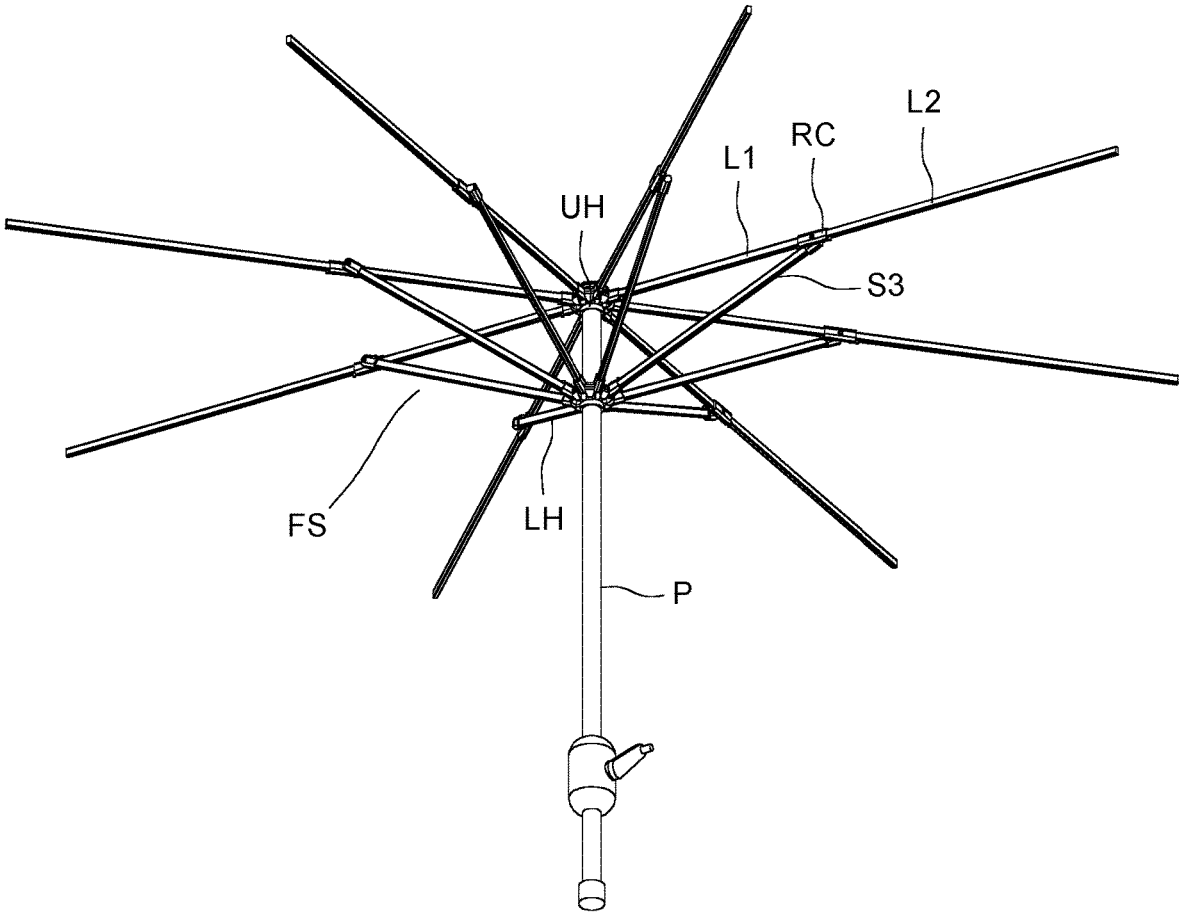
FIGS. 4-8 are perspective views of the collapsible umbrella depicted in FIGS. 1-3, with the canopy removed, in accordance with one embodiment of the present invention.
Figure 5:
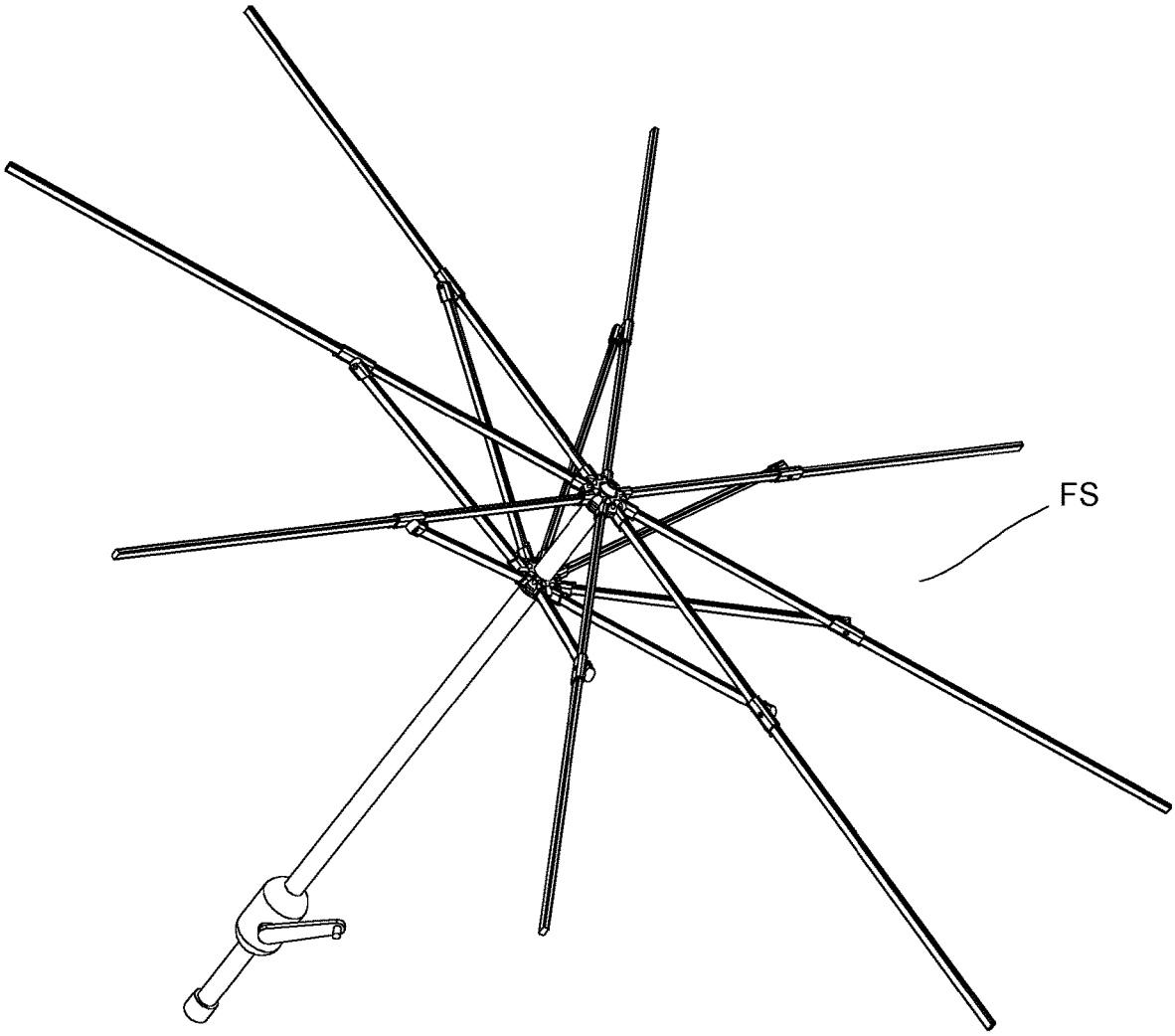
Figure 6:
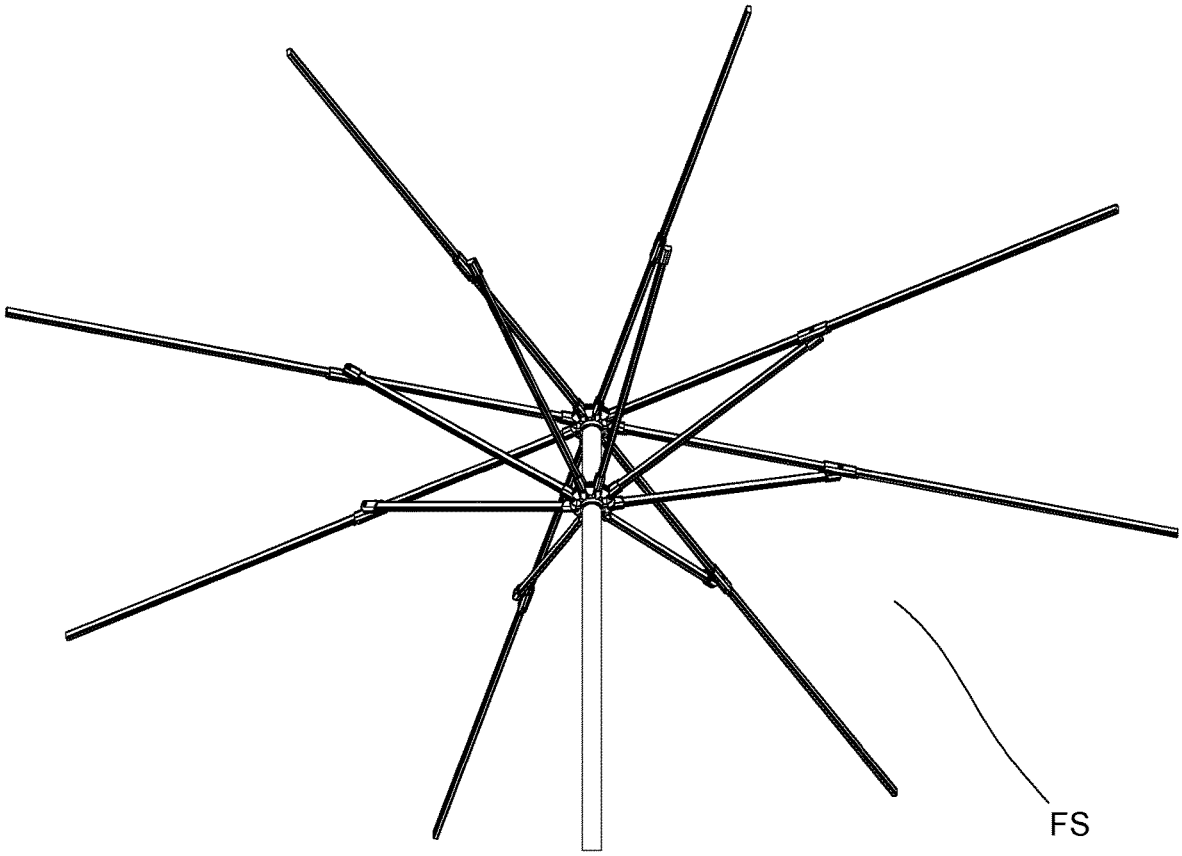

FIGS. 1-3 are various perspective views of a collapsible umbrella U, depicted in a fully extended state, comprising a frame structure FS supported on a central support post P, in accordance with one embodiment of the present invention. FIGS. 4-8 are perspective views of the collapsible umbrella U depicted in FIGS. 1-3, with the canopy C removed, in accordance with one embodiment of the present invention.

Figure 8:
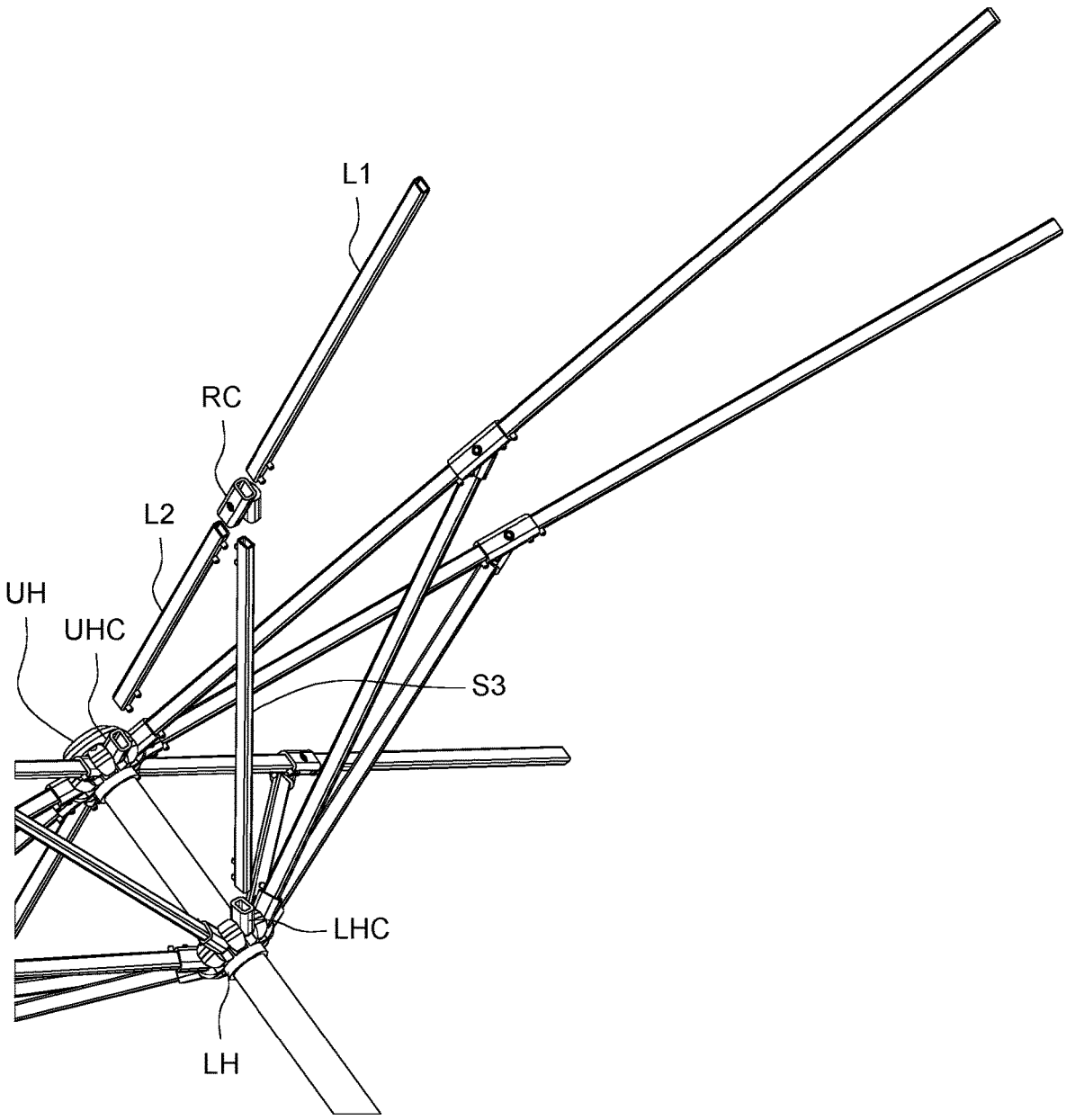
Figure 9:
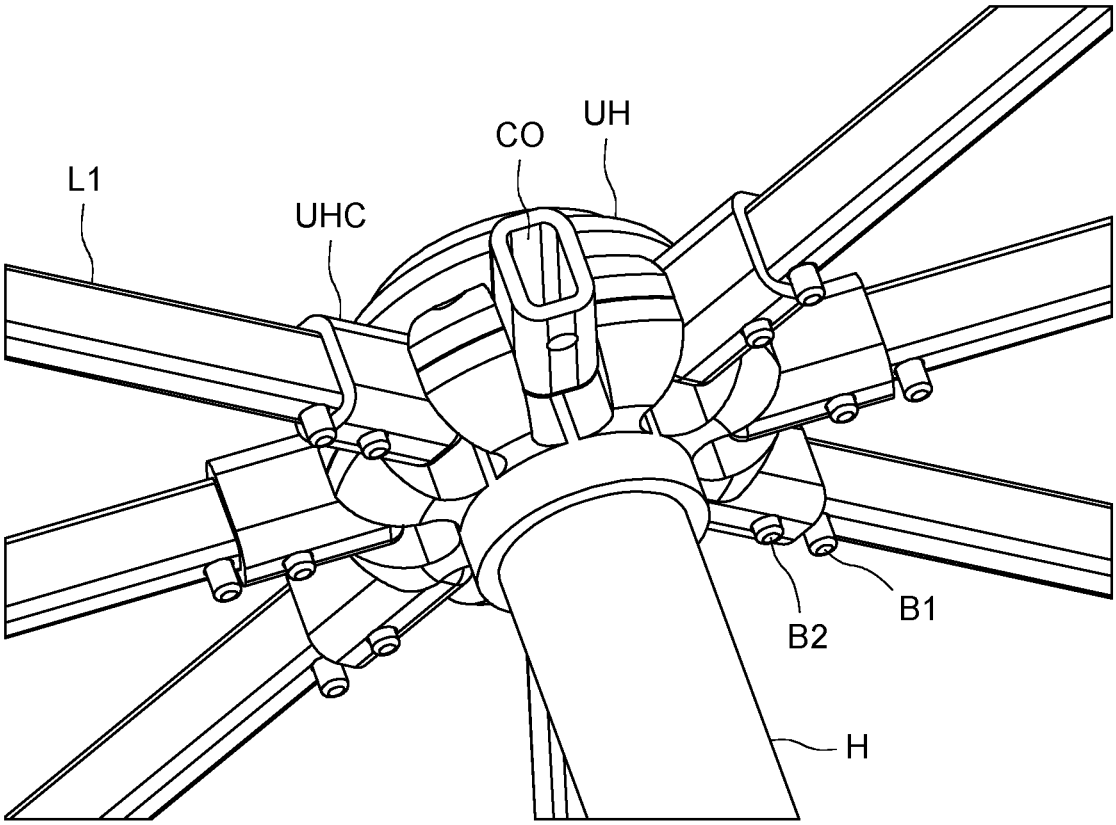
FIGS. 9-14 are various perspective views of the upper and lower hubs of the frame structure, and releasable coupling to rib sections, in accordance with one embodiment of the present invention.
Figure 10:
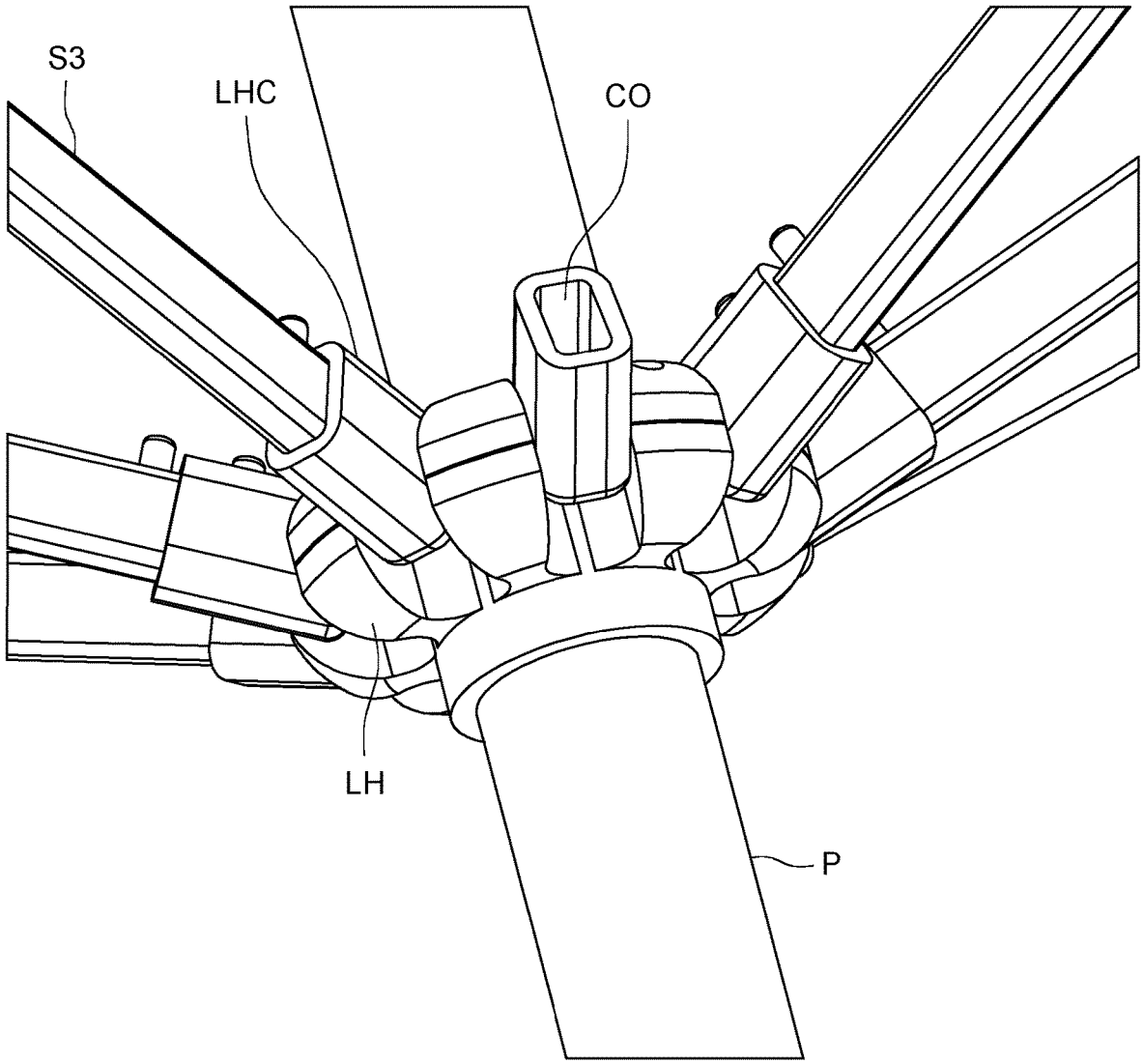
Figure 11:
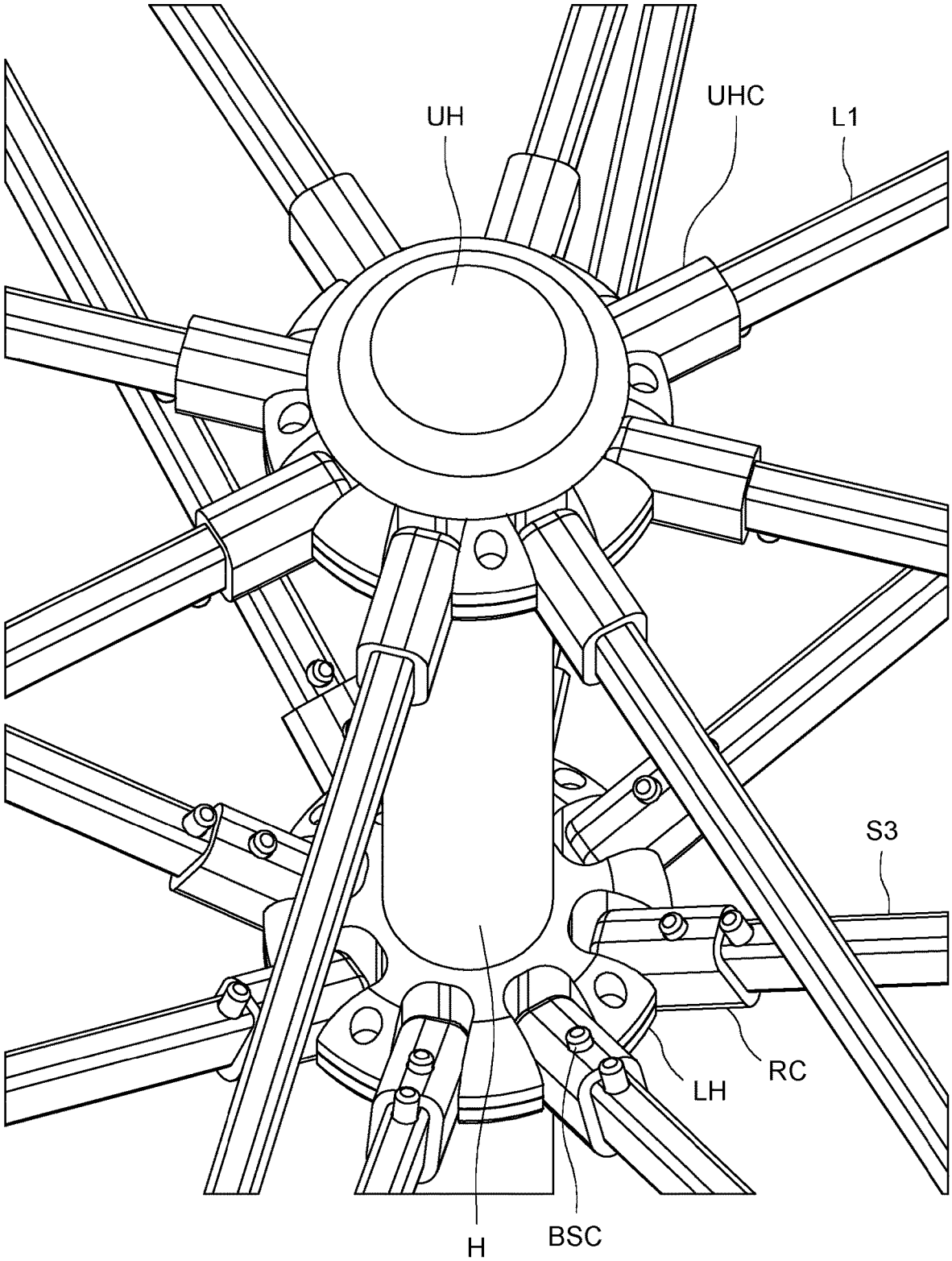
Figure 12:
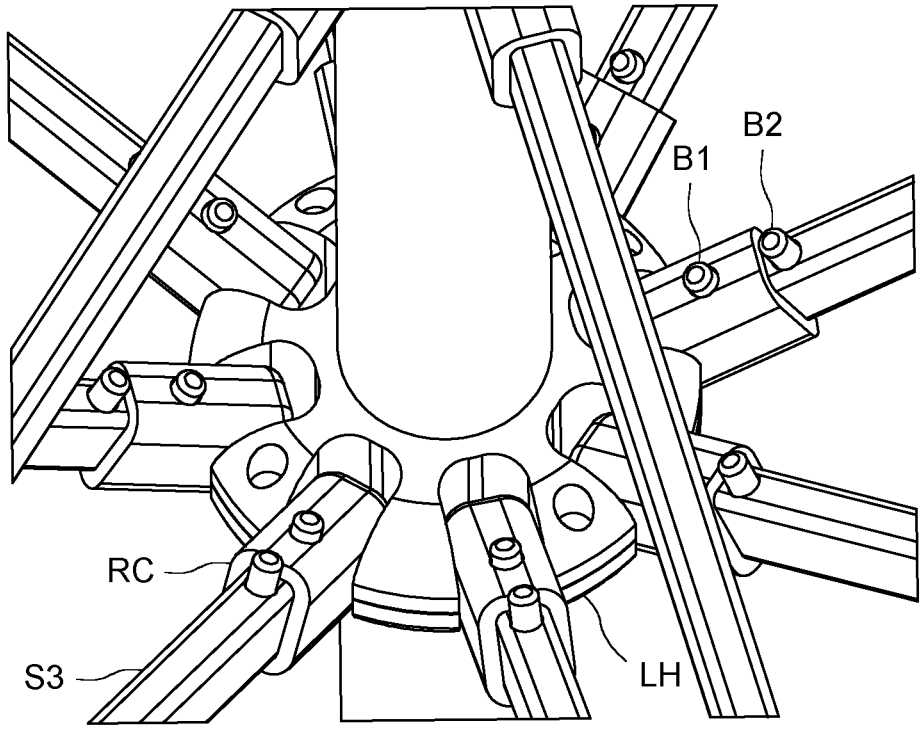
Figure 13:
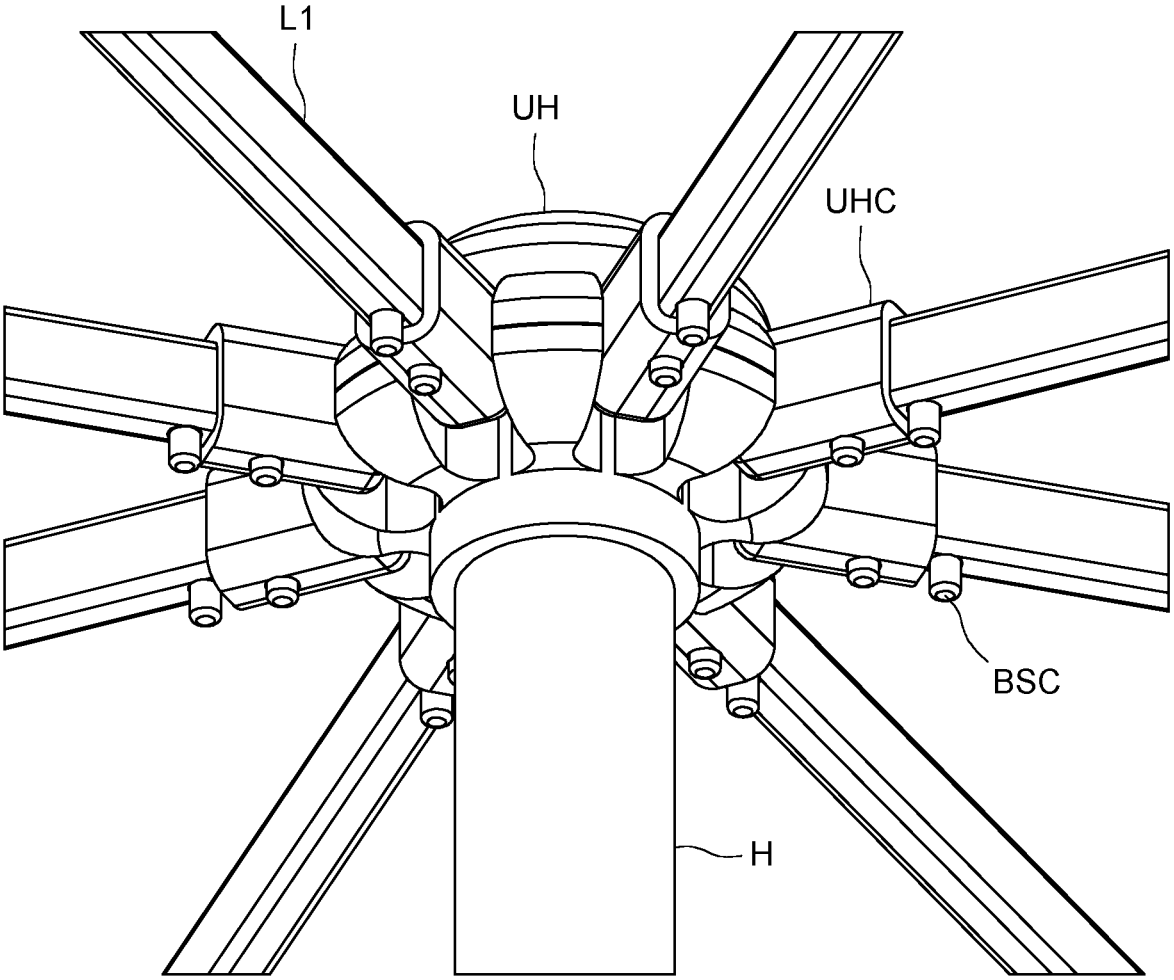
Figure 14:
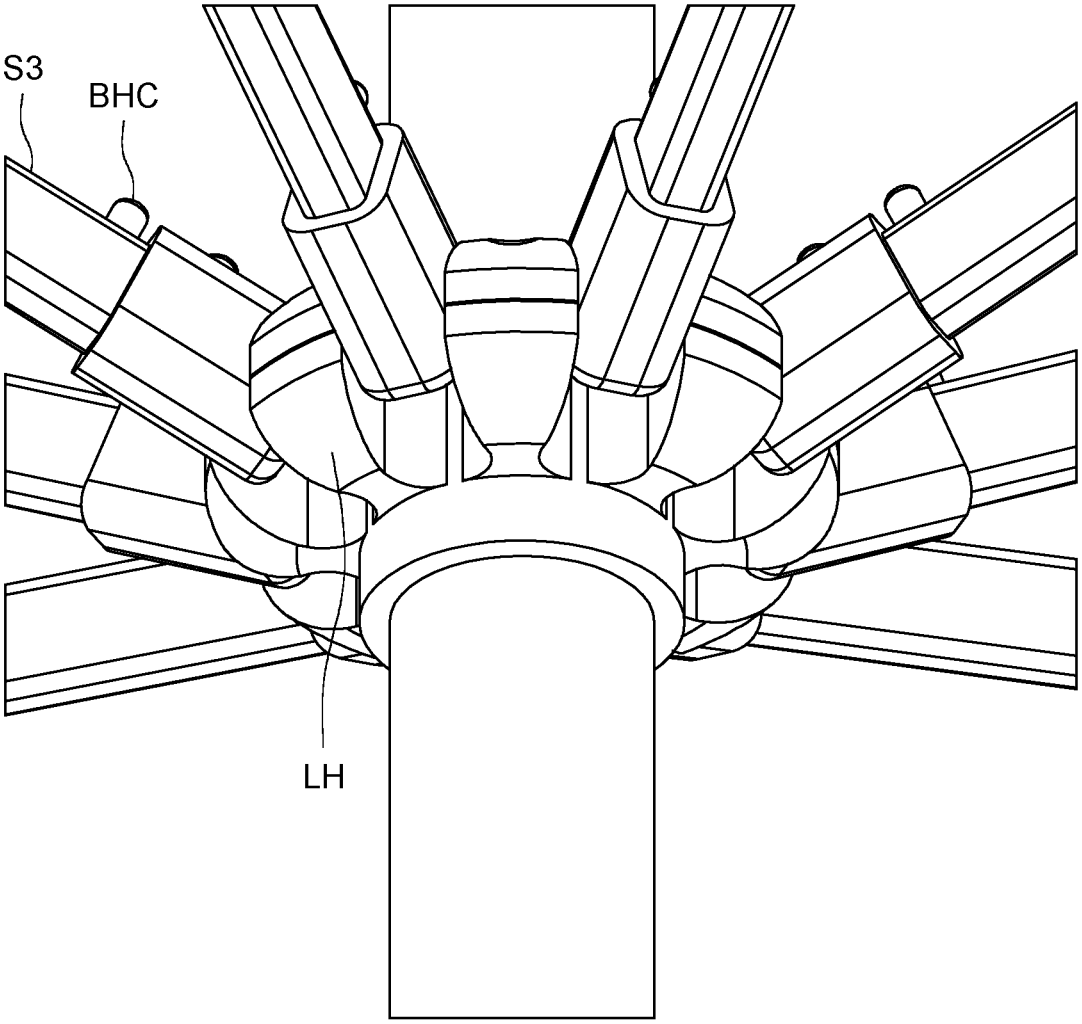

As illustrated by the figures, the inventive collapsible umbrella U comprises a support structure SS, a frame structure FS supported by the support structure SS, comprising: a support hub H (generally denoting the region corresponding to the support hub assembly in the embodiments depicted in the figures); a plurality of long ribs L, each comprising a first rib section L1 and a second rib section L2 releasably connected by a pivot rib coupler RC, wherein each long rib L has an end releasably coupled to an upper end of the support hub H; a plurality of short rib sections S in the form of a plurality of third rib sections S3, each comprising a first end releasable coupled to the pivot rib coupler RC and a second end releasably coupled to a lower end of the support hub H, wherein each pivot rib coupler RC is configured to pivotal the third rib section S3 relative to the first and second rib sections L1, L2 that are releasably coupled to the pivot rib coupler RC. FIG. 8 depicts an exploded view of the assembly of the first, second and third rib sections (L2, L2, S3), the pivot rib coupler RC, and the upper and lower pivot hub connectors UHC, LHC.

A canopy C comprising a flexible material (e.g., canvas, fabric, etc.) is supported on the frame structure FS, with the flexible material spanning over the long ribs L. Once assembled, the collapsible umbrella U can be operated to open/extend or close/collapse the canopy C in similar fashion as known collapsible umbrellas.

FIGS. 9-14 are various perspective views of the upper and lower hubs UH, LH of the frame structure FS, and releasable coupling to rib sections L1, L2, S3, in accordance with one embodiment of the present invention. In the illustrated embodiment, the support hub H comprises an upper hub UH at the upper end of the support hub H, and a plurality of upper pivot hub connectors UHC each having an end pivotally coupled to the upper hub UH, wherein a second end of each first rib section L1 is releasably coupled to an extended end of a corresponding upper pivot hub connector UHC; and a lower hub LH at the lower end of the support hub H, and a plurality of lower pivot hub connector LHC each having an end pivotally coupled to the lower hub LH, wherein a second end of each third rib section S3 is releasably coupled to an extended end of a corresponding lower pivot hub connector LHC. The upper and lower hubs UH, LH and/or the upper and lower pivot hub connectors UHC, LHC could be made of an appropriate rigid material, such as metal (e.g., aluminum, iron or steel), composite materials, plastics, etc.

Figure 15:
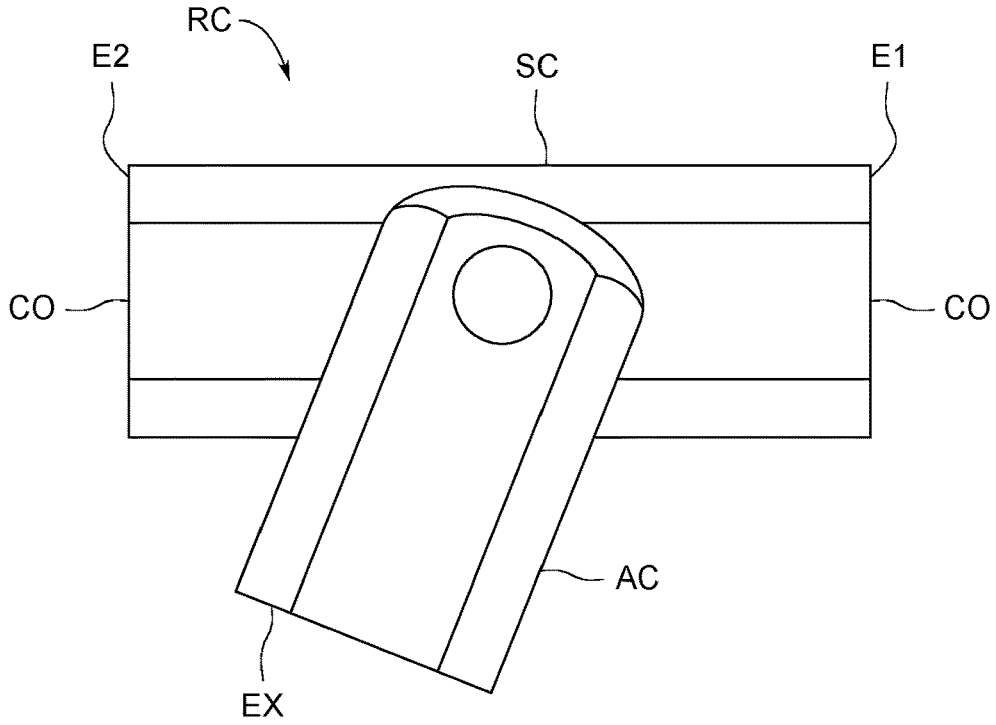
FIGS. 15-16 are various perspective views of the pivot rib coupler, in accordance with one embodiment of the present invention.
Figure 16:
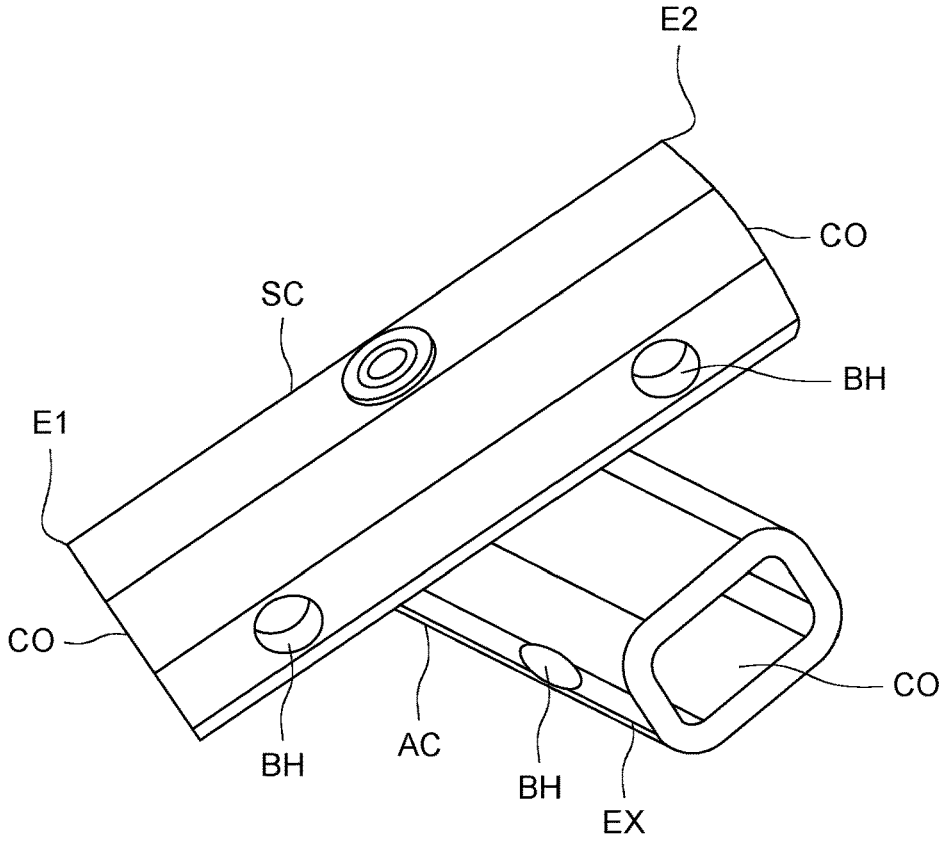
Figure 17:
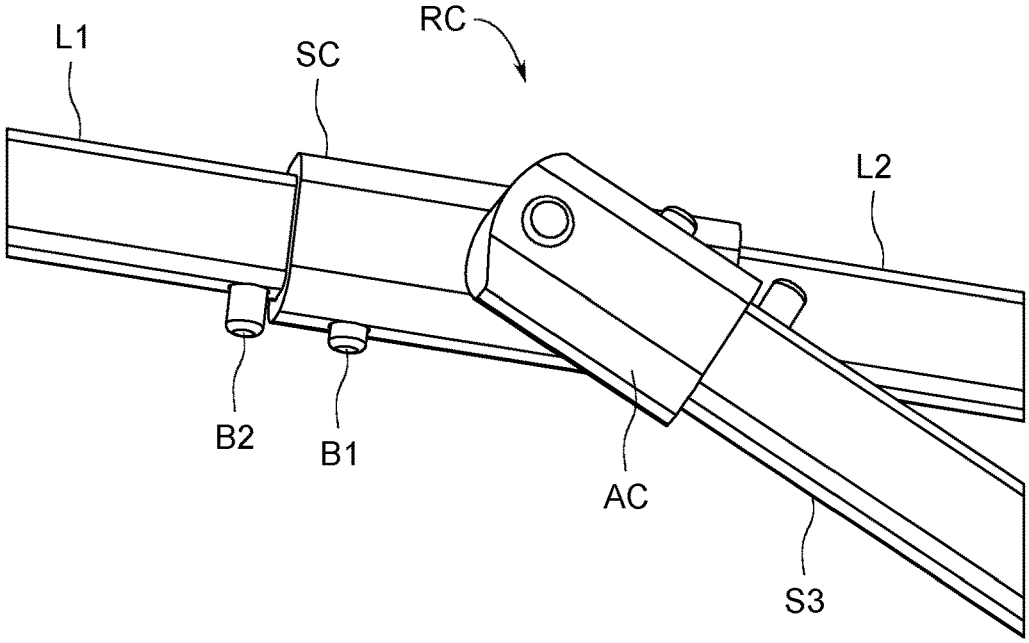
FIGS. 17-20 are various perspective views of releasable coupling of pivot rib couplers and rib sections, in accordance with one embodiment of the present invention.
Figure 18:
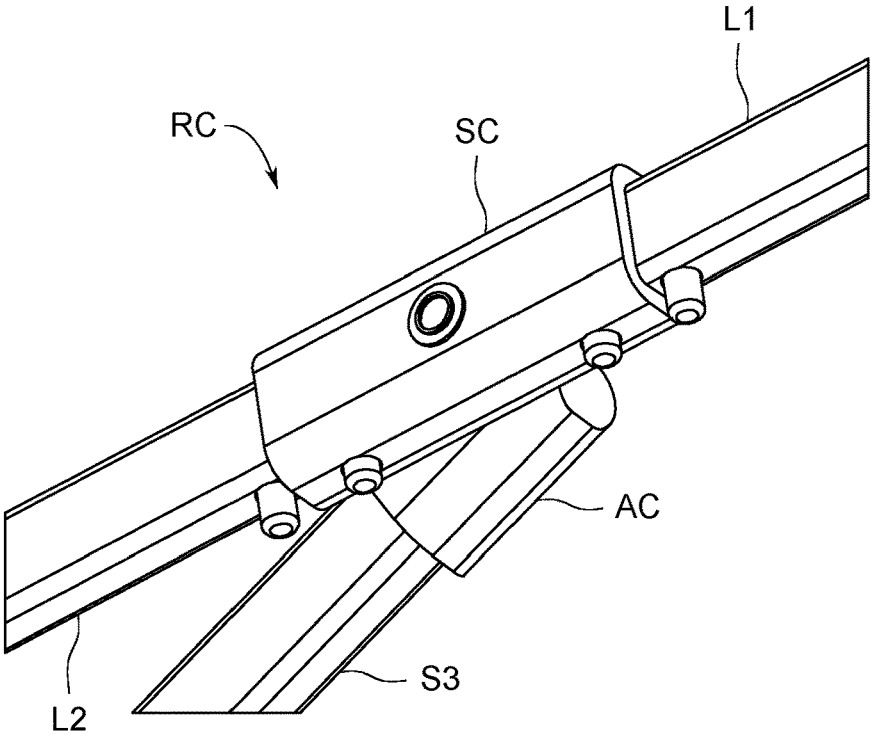
Figure 19:
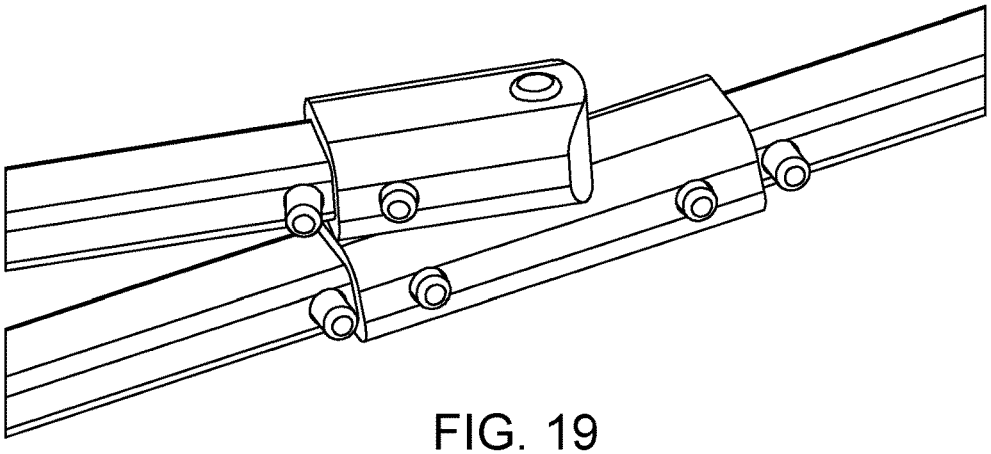
Figure 20:
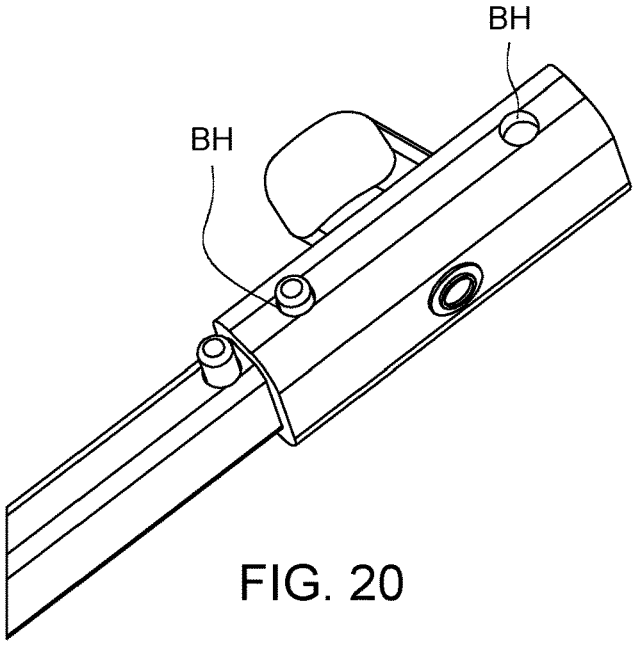

FIGS. 15-16 depict various perspective views of the pivot rib coupler RC, in accordance with one embodiment of the present invention. As illustrated, the pivot rib coupler RC comprises a straight pivot portion SC having a first end E1 and a second end E2, and an angled pivot portion AC having an end pivotally connected to the straight pivot portion SC and an extended end EX, wherein a first end of the first rib section L1 is releasably coupled to the first end E1 of the straight pivot portion SC of the pivot rib coupler RC, and a first end of the second rib section L2 is releasably coupled to the second end E2 of the straight pivot portion SC of the pivot rib coupler RC, wherein the first end of the third rib section S3 is releasably coupled to the extended end EX of the angled pivot portion AC of the pivot rib coupler RC.

In one embodiment, the first end E1 and the second end E2 of the straight pivot portion SC of each pivot rib coupler RC, the extended end EX of the angled pivot portion AC of each pivot rib coupler RC, the extended end of each upper pivot hub connector UHC, and the extended end of each lower pivot hub connector LHC, are each an opened end (i.e., a coupling opening CO) sized and configured to receive an end of a corresponding one of the first, second and third rib sections L1, L2, S3.

FIGS. 17-20 are various perspective views of removable/releasable coupling of pivot rib couplers RC and rib sections L1, L2, S3, in accordance with one embodiment of the present invention. In one embodiment, the first end of each of the first rib sections L1, the second rib sections L2 and the third rib sections S3 are releasably coupled to the corresponding first, second and extended ends E1, E2, EX of the pivot rib coupler RC, the second end of each of the first rib sections L2 is releasably coupled to the corresponding extended end of the upper pivot hub connector UHC, and the second end of each of the third rib sections S3 is releasably coupled to the corresponding extended end of the lower pivot hub connector LHC. In the illustrate embodiment, the releasable coupling comprising a user finger operated releasable coupling that does not require using an external tool for a user to release the coupling. In one embodiment, the releasable coupling comprises a push button spring clip BSC at the first and second ends of each of the first and third rib sections L1, S3 and the first end of each of the second rib sections L2, and a complementary opening provided at the corresponding first, second and extended ends E1, E2, EX of the pivot rib coupler RC, extended end of the upper pivot hub connector UHC and extended end of the lower pivot hub connector LHC.

Figure 24:
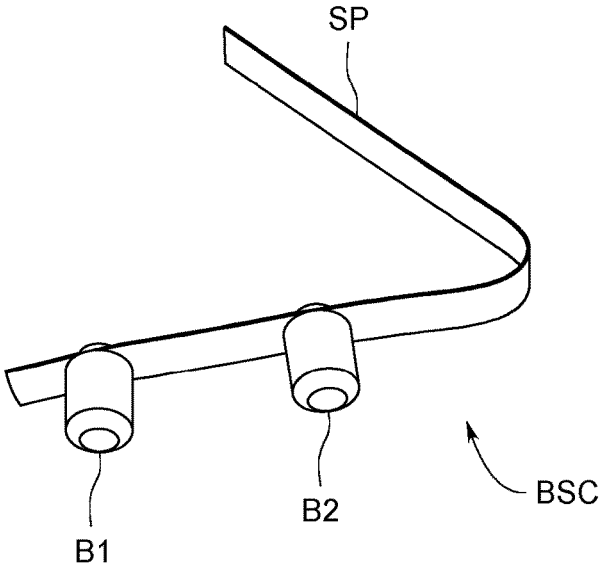
FIG. 24 depicts a double push button spring clip, in accordance with one embodiment of the present invention.

To facilitate ease of assembly of the rib sections to the complementary components, the releasable coupling may be of the type generally referred to as a double push button spring clip BSC. FIG. 24 depicts a double push button spring clip BSC, in accordance with one embodiment of the present invention. This double push button spring clip BSC includes first and second push buttons (protrusions) B1, B2 attached onto or otherwise formed with (e.g., by stamping integral therewith) the flat spring material of the spring clip that is in a generally V-shape, with two prongs SP providing counter spring bias when the prongs SP are brought closer by an external force. The spring material may be metal (e.g., spring steel) or plastic. FIG. 24 depicts the embodiment of a metal double push button spring clip BSC.

Figure 21:
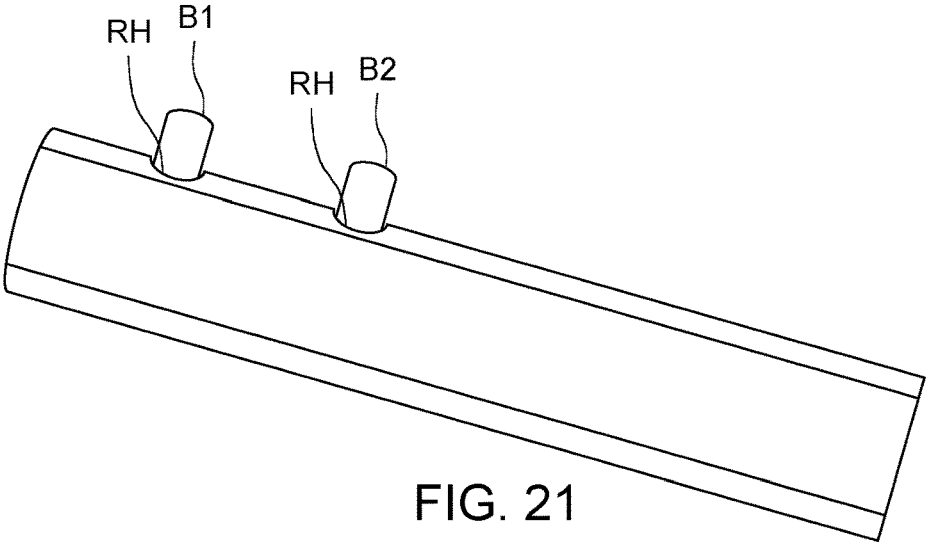
FIG. 21 depicts a double push button spring clip at one end of a rib section, in accordance with one embodiment of the present invention.

FIG. 21 depicts the double push button spring clip BSC inserted into an end portion of a rib section (L1, L2, S3), in accordance with one embodiment of the present invention. The first and second button B1, B2 protrude through complementary holes RH provided in the wall of the end portion. The user presses on the second push button B2 that is located further from the end of the rib section (L1, L2, S3), against the spring bias of the flat spring, thereby lowering/depressing the first button B1 that is closer to the end of the rib section to be generally flush with the external wall of at the end of the rib section. This allows the end portion of the rib section to be inserted into the coupling opening CO of a complementary component (e.g., at an extended end of a pivot rib coupler RC or a pivot hub connector LHC, UHC). The first button B1 of the clip is at the inserted end portion of the rib section (L1, L2, S3). A hole BH is provided on the corresponding wall of the coupling opening CO, which receives the first button B1, thereby preventing the end portion of the rib section from being withdrawn from the coupling opening, thus securing the end portion of the rib section (L1, L2, S3) relative to the coupling opening CO. To release the rib section (L1, L2, S3) from the coupling opening CO, the user can press on the second button B2 to lower/depress the first button B1 to allow the end portion of the rib section (L1, L2, S3) to be withdrawn from the coupling opening CO. In the illustrated embodiment, each first and third rib sections L1, S3 has both ends and each second rib section L2 has one end provided with the metal push button spring clip BSC.

While the illustrated embodiment depicts the push button spring clip provided at the end portion of the rib section (L1, L2, S3) and the hole RH is provided at the wall of the coupling opening CO, their locations can be swapped without departing from the scope and spirit of the present invention.

While the illustrated embodiment depicts the push button spring clip to be a double push button spring clip, a single push button spring clip may be used, in which case a first button at the end of the rib section is depressed directly by a user in order to insert the end portion into or withdrawn the end portion from the coupling opening.

Figure 7:
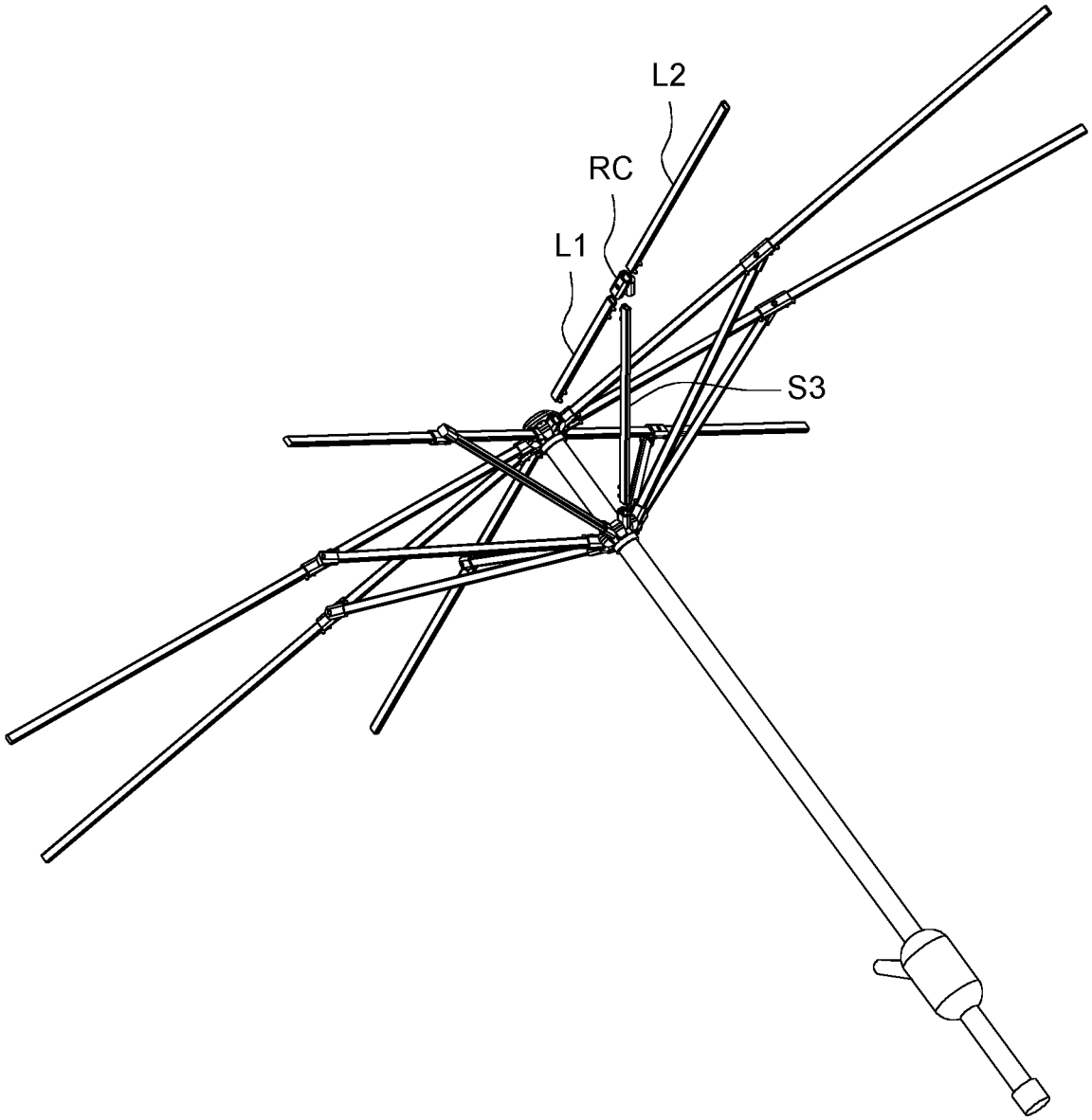
Figure 22:
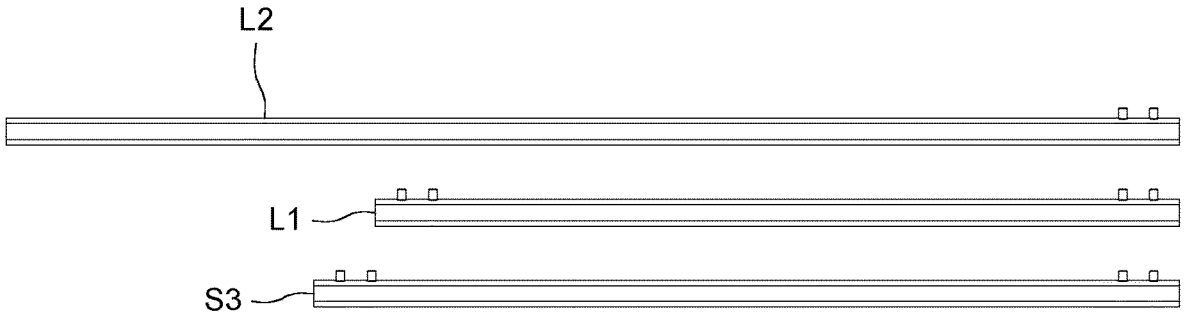
FIG. 22 depicts replaceable rib sections of different lengths, in accordance with one embodiment of the present invention.

The replaceable rib sections L1, L2, S3 may be of same or different lengths, depending on the size of the frame structure for the desired collapsible umbrella. FIG. 22 depicts replaceable rib sections L1, L2, S3 of different lengths, in accordance with one embodiment of the present invention. In the illustrated embodiment (also referring to the exploded view of FIG. 8 that depicts a branch of ribs of the frame structure as also shown in FIG. 7), the shortest rib section corresponds to the first rib section L1 of the long rib; the longest rib section corresponds to the second rib section L2 of the long rib; and the medium length rib section corresponds to the third rib section S3. This is consistent with the depiction in the exploded view in FIG. 8, of the assembly of first, second and third rib sections L1, L2, S3, the pivot rib coupler RC, and the upper and lower pivot hub connectors UHC, LHC. Each rib section L1, L2, S3 is in the form of an elongated, slender beam, in the form of a straight tubing having a uniform cross section along its length, as depicted in the illustrated embodiment. Other configuration of the beam, uniform or non-uniform cross section, could be used. The rib sections L1, L2, S3 could be made of an appropriate rigid material, such as metal (e.g., aluminum, iron or steel), composite materials, plastics, etc.

To reduce part variations, at least two of the first rib section, the second rib section and the third rib section L1, L2, S3 may be similar in length and are interchangeable. For example, the first and third rib sections L1, S3 may be of similar length and interchangeable. In another embodiment, the first rib section L1, the second rib section L2 and the third rib section S3 are all similar in length and are interchangeable.

Figure 23:
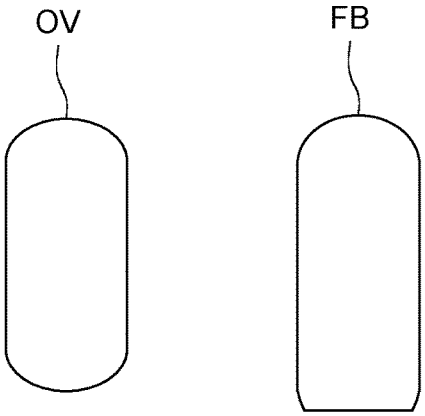
FIG. 23 depicts cross-sectional profiles of rib sections, in accordance with alternate embodiments of the present invention.

FIG. 23 depicts cross-sectional profiles of rib sections L1, L2, S3, in accordance with embodiments of the present invention. The rib sections may have a generally stretched round or oval shaped cross-section (or a rectangle with opposing rounded sides in the major axis), which is symmetrical about two orthogonal axes in the cross-sectional plane. With the rib sections assembled in the frame structure of the collapsible umbrella, this stretched sectional configuration of the rib sections can better withstand the anticipated stronger vertical component load relative to the anticipated lighter lateral component load. The complementary coupling openings in the first, second and extended ends of the pivot rib coupler, extended end of the upper pivot hub connector and extended end of the lower pivot hub connector each may have a similar stretched round or oval shaped cross-section, or simply an opening of another geometry that is sized to accommodate the inserted end of the rib section.

In another embodiment depicted in FIG. 23, at least a portion at the respective ends of the various rib sections (i.e., the portion of the rib sections at which the double push button spring clip is located) may be profile indexed, e.g., provided with a cross-sectional shape that is non-symmetrical about at least one axis in the sectional plane. In the illustrated embodiment, the cross-sectional profile shape conforms to a rounded top and flat bottom FB (i.e., as compared to the other embodiment, the stretched round/oval is provided with a flat bottom). The complementary coupling openings in the first, second and extended ends E1, E2, EX of the pivot rib coupler RC, extended end of the upper pivot hub connector UHC and extended end of the lower pivot hub connector LHC each has a similar cross-section profile. This provides a unique, positive, indexed, coupling profile to facilitate matching the orientation of the ends of the rib sections to complementary openings at the corresponding first, second and extended ends of the pivot rib coupler, extended end of the upper pivot hub connector and extended end of the lower pivot hub connector. As a result, a user would not confuse the orientation of a rib section L1, L2, S3 with respect to a coupling opening CO, thereby ensuring the first push button B1 at the end of the rib section L1, L2, S3 will match up with the hole BH at the coupling opening CO.

In another embodiment, rib sections L1, L2, S3 may be configured with other cross-sectional profiles. For example, instead of tube-shaped beams having cross-section of closed walls, open wall cross-section, such as generally channel-shaped (e.g., U-shaped or V-shaped) beams may be adopted for the rib sections. Alternatively, beams having cross-sections of other geometrical shapes, such as I-shaped, rectangle-shaped, triangle-shape, etc., cross-sections, may be adopted for the rib sections.

In another embodiment, the rib sections may have different cross-section profiles. For example, the first and second rib sections may have similar cross-section profile, and the third rib section may have a cross-section profile different from that of the first and second rib sections.

While the above described embodiments include complementary coupling openings and rib section ends of similar cross-sectional profile shapes, the cross-sectional profile of the end portion of the rib section and the coupling opening do not need to be similar to be complementary. For example, an I-shaped cross-section of the rib section may be received in a complementary coupling opening that has a rectangular cross-section profile.

The umbrella support structure SS may comprise a central support post P, wherein the frame structure FS is supported at an upper end of the central support post P, as depicted in the illustrated embodiment, or a side support post (not shown) and an arm cantilevered from the side support post, wherein the frame structure FS is supported at an extended end of the arm. For example, the inventive frame structure features of the present invention may be adopted in a side supported umbrella, such as the one disclosed in U.S. Pat. No. 10,136,709B2, which is incorporated by reference herein.

It is appreciated that for a particular umbrella support structure that is partially assembled with a hub structure, different lengths of rib sections may be selectively chosen to assemble a frame that can accommodate canopies of different sizes. For example, the second rib section extending from and pivot rib coupler may be chosen to have a shorter or longer length to accommodate a canopy of a smaller or larger area, respectively.

In a further embodiment, instead of releasably coupling to the upper end and lower end of the support bub as in the above described and illustrated embodiments, each long rib L has an end fixedly coupled to the upper end of the support hub H, and each third rib sections S comprises a second end fixedly coupled to a lower end of the support hub H. As in the above described embodiments, an upper hub UH is provided at the upper end of the support hub H and a plurality of upper pivot hub connectors UHC each having an end pivotally coupled to the upper hub UH, wherein a second end of each first rib section L1 is fixedly coupled (e.g., using rivets, epoxy, bolts, screws, etc.) to an extended end of a corresponding upper pivot hub connector UHC; and a lower hub LH is provided at the lower end of the support hub H and a plurality of lower pivot hub connectors LHC each having an end pivotally coupled to the lower hub LH, wherein a second end of each third rib section S3 is fixedly coupled (e.g., using rivets, epoxy, bolts, screws, etc.) to an extended end of a corresponding lower pivot hub connector LHC. For example, instead of using finger operated releasable couplings as in the previously disclosed embodiments, the second end of each of the first and third rib sections L1, S3 can be inserted into a complementary opening at the extended end of the corresponding upper and lower pivot hub connectors UHC, LHC and said second end may be fastened to said opening at the extended end of the upper and lower pivot hub connectors UHC, LHC by rivets, expoxy, bolts, screws, etc. or a combination of such fasteners.

The inventive frame structure for the collapsible umbrella achieves at least the following advantages over the prior art:

a. The quick connect coupling of the rib sections to the hub structure allows the collapsible umbrella frame to be easily assembled at the point of use, thus not have to rely on full assembly of the collapsible umbrella frame at the point of manufacture.

b. The collapsible umbrella frame structure can be partially assembled at the point of manufacture with the hub structure assembled to the support structure or part thereof, which results in a smaller package that would reduce significant shipping costs compared to shipping costs imposed on a more bulky fully assembled umbrella frame structure.

c. The removable, replaceable and/or interchangeable rib sections permits repairing of damaged rib of an umbrella frame by replacing the damaged rib section, thus not leading to premature waste of the rest of the umbrella.

d. The rib sections facilitate inventory management, with potentially lesser part variations. Having rib sections of similar lengths leads to less variation in rib sections. Further, for the same partially assembled core support structure and hub structure, different size rib sections can be used to assemble a frame structure that can accommodate different size canopies to assemble umbrella of different sizes. So, it would not be necessary to maintain inventory of complete umbrella assemblies of different size canopies. Different size canopies can be accomplished by using rib sections of desired lengths with the same core partially assembled frame structure.

e. User may decide to change the size of the canopy without having to purchase an entire new umbrella including fully assembled frame structure. User may simply replace some of the rib sections (e.g., the second rib sections extending from the pivot rib coupler) and replace the canopy.

e. The rib sections may be sold as replacement parts, thus generating more revenue for the seller.

f. The rib sections facilitate warranty replacement of only damaged rib sections, instead of having to replace an entire umbrella with only a damage rib, thus lessen the burden on fulfillment of warranty claims by the seller/manufacturer and potentially improving customer satisfactions.

While the present invention has been described above in connection with the illustrated embodiments, the scope of patent invention covers all possible present and future variations and improvements that is apparent from the disclosure above. While the invention has been particularly shown and described with reference to the preferred embodiments, it will be understood by those skilled in the art that various changes in form and detail may be made without departing from the spirit, scope, and teaching of the invention. Accordingly, the disclosed invention is to be considered merely as illustrative and limited in scope only as specified in the appended claims.

The invention claimed is:

1. An umbrella, comprising:

a support structure, a frame structure supported by the support structure, comprising:

a support hub assembly;

a plurality of long ribs, each comprising a first rib section and a second rib section releasably connected by a pivot rib coupler, wherein each long rib has an end releasably or fixedly coupled to an upper end of the support hub assembly;

a plurality of short rib sections in the form of a plurality of third rib sections, each comprising a first end coupled to the pivot rib coupler and a second end releasably or fixedly coupled to a lower end of the support hub assembly, wherein each pivot rib coupler is configured to pivot the third rib section relative to the first and second rib sections that are coupled to the pivot rib coupler, wherein the pivot rib coupler comprises a straight pivot portion having a first end and a second end, and an angled pivot portion having an end pivotally connected to the straight pivot portion and an extended end, wherein a first end of the first rib section is coupled to the first end of the straight pivot portion of the pivot rib coupler, a first end of the second rib section is releasably coupled to the second end of the straight pivot portion of the pivot rib coupler, and the first end of the third rib section is coupled to the extended end of the angled pivot portion of the pivot rib coupler, wherein the second end of the straight pivot portion of each pivot rib coupler is an opened end configured to receive the first end of the second rib section, wherein the first end of each of the second rib sections is releasably coupled to a respective second end of the pivot rib coupler using a user finger operated releasable quick connect coupling comprising a push button spring clip at the first end of each of the second rib section and a complementary opening at the respective second ends of the pivot rib coupler, which does not require using an external tool for a user to release the user finger operated releasable quick connect coupling.

2. The umbrella as in claim 1, wherein the first end of the first rib section is releasably coupled to the first end of the straight pivot portion of the pivot rib coupler, and wherein the first end of the third rib section is releasably coupled to the extended end of the angled pivot portion of the pivot rib coupler.

3. The umbrella as in claim 2, wherein the first end of the straight pivot portion of each pivot rib coupler, and the extended end of the angled pivot portion of each pivot rib coupler, are each an opened end configured to receive the first end of a corresponding one of the first and third rib sections.

4. The umbrella as in claim 3, wherein the first end of each of the first rib sections and the third rib sections is releasably coupled to the corresponding first and extended ends of the pivot rib coupler.

5. The umbrella as in claim 4, wherein the first end of each of the first rib sections and the third rib sections is releasably coupled to the corresponding first and extended ends of the pivot rib coupler using a user finger operated releasable quick connect coupling that does not require using an external tool for a user to release the user finger operated releasable quick connect coupling, wherein the user finger operated releasable quick connect coupling comprises a push button spring clip at the first end of each of the first and third rib sections, and a complementary opening at the corresponding first and extended ends of the pivot rib coupler.

6. The umbrella as in claim 5, wherein at least two of the first rib section, the second rib section and the third rib section are similar in length and are interchangeable.

7. The umbrella as in claim 6, wherein the first and second rib sections are similar in length and are interchangeable.

8. The umbrella as in claim 1, wherein the support hub assembly comprises:

an upper hub at the upper end of the support hub assembly, and a plurality of upper pivot hub connectors each having an end pivotally coupled to the upper hub, wherein a second end of each first rib section is releasably or fixedly coupled to an extended end of a corresponding upper pivot hub connector; and a lower hub at the lower end of the support hub assembly, and a plurality of lower pivot hub connectors each having an end pivotally coupled to the lower hub, wherein a second end of each third rib section is releasably or fixedly coupled to an extended end of a corresponding lower pivot hub connector.

9. The umbrella as in claim 8, wherein the second end of each of the first rib sections is releasably coupled to the extended end of the corresponding upper pivot hub connector, and the second end of each of the third rib sections is releasably coupled to the extended end of the corresponding lower pivot hub connector.

10. The umbrella as in claim 9, wherein the second end of each of the first rib sections is releasably coupled to the extended end of the corresponding upper pivot hub connector and the second end of each of the third rib sections is releasably coupled to the extended end of the corresponding lower pivot hub connector using a user finger operated releasable quick connect coupling that does not require using an external tool for a user to release the coupling.

11. The umbrella as in claim 10, wherein the user finger operated releasable quick connect coupling comprises a push button spring clip at the second ends of each of the first and third rib sections, and a complementary opening at the extended end of the corresponding upper pivot hub connector and extended end of the corresponding lower pivot hub connector.

12. The umbrella as in claim 1, wherein the user finger operated releasable quick connect coupling comprises a double push button spring clip.

13. The umbrella as in claim 1, wherein at least a portion at the first end of each of the second rib sections is provided with a cross-sectional shape that is non-symmetrical about at least one axis in a sectional plane, to facilitate user matching of the end of each of the rib sections to the complementary opening at the respective second ends of the pivot rib coupler.

14. The umbrella as in claim 13, wherein the cross-sectional shape conforms to a rounded top and flat bottom.

15. The umbrella as in claim 1 wherein the support structure comprises (a) a central support post, wherein the frame structure is supported at an upper end of the central support post, or (b) a side support post and an arm cantilevered from the side support post, wherein the frame structure is supported at an extended end of the arm.

16. An umbrella, comprising:

a support structure, a frame structure supported by the support structure, comprising:

a support hub;

a plurality of long ribs, each comprising a first rib section and a second rib section releasably connected by a pivot rib coupler, wherein each long rib has an end releasably or fixedly coupled to an upper end of the support hub;

a plurality of short rib sections in the form of a plurality of third rib sections, each comprising a first end releasable coupled to the pivot rib coupler and a second end releasably or fixedly coupled to a lower end of the support hub, wherein each pivot rib coupler is configured to pivot the third rib section relative to the first and second rib sections that are releasably coupled to the pivot rib coupler, wherein the support hub comprises:

an upper hub at the upper end of the support hub, and a plurality of upper pivot hub connectors each having an end pivotally coupled to the upper hub, wherein a second end of each first rib section is releasably or fixedly coupled to an extended end of a corresponding upper pivot hub connector; and a lower hub at the lower end of the support hub, and a plurality of lower pivot hub connectors each having an end pivotally coupled to the lower hub, wherein a second end of each third rib section is releasably or fixedly coupled to an extended end of a corresponding lower pivot hub connector, wherein the second end of each of the first rib sections is releasably coupled to the extended end of the corresponding upper pivot hub connector, and the second end of each of the third rib sections is releasably coupled to the extended end of the corresponding lower pivot hub connector, wherein the second end of each of the first rib sections is releasably coupled to the extended end of the corresponding upper pivot hub connector and the second end of each of the third rib sections is releasably coupled to the extended end of the corresponding lower pivot hub connector using a user finger operated releasable quick connect coupling that does not require using an external tool for a user to release the coupling, wherein the user finger operated releasable quick connect coupling comprises a push button spring clip at the second ends of each of the first and third rib sections, and a complementary opening at the extended end of the corresponding upper pivot hub connector and extended end of the corresponding lower pivot hub connector.

17. An umbrella, comprising:

a support structure, a frame structure supported by the support structure, comprising:

a support hub assembly;

a plurality of long ribs, each comprising a first rib section and a second rib section releasably connected by a pivot rib coupler, wherein each long rib has an end releasably or fixedly coupled to an upper end of the support hub assembly;

a plurality of short rib sections in the form of a plurality of third rib sections, each comprising a first end releasable coupled to the pivot rib coupler and a second end releasably or fixedly coupled to a lower end of the support hub assembly, wherein each pivot rib coupler is configured to pivot the third rib section relative to the first and second rib sections that are releasably coupled to the pivot rib coupler, wherein at least a portion at respective ends of the various rib sections is provided with a cross-sectional shape that is non-symmetrical about at least one axis in a sectional plane, to facilitate user matching of the ends of the rib sections to complementary openings at the corresponding first, second and extended ends of the pivot rib coupler, extended end of the upper pivot hub connector and extended end of the lower pivot hub connector.

18. The umbrella as in claim 17, wherein the cross-sectional shape conforms to a rounded top and flat bottom.

* * * * *